US005365687A

United States Patent [19]

Sclater

[11] Patent Number: 5,365,687

[45] Date of Patent: Nov. 22, 1994

[54] MOTOR VEHICLE ROOF-TOP DISPLAY FRAME ASSEMBLY

[75] Inventor: William C. Sclater, Cos Cob, Conn.

[73] Assignee: United States Tobacco Company, Greenwich, Conn.

[21] Appl. No.: 856,116

[22] Filed: Mar. 23, 1992

Related U.S. Application Data

[63] Continuation-in-part of Ser. No. 556,190, Jul. 20, 1990, abandoned.

[51] Int. Cl.[5] ..... G09F 15/00

[52] U.S. Cl. ..... 40/610; 40/591; 40/603

[58] Field of Search ..... 40/592, 591, 590, 589, 40/588, 603, 604, 610, 612; 403/59, 80, 85

[56] References Cited

U.S. PATENT DOCUMENTS

| | | | |
|---|---|---|---|
| 2,793,453 | 5/1957 | Bixby . | |
| 2,816,377 | 12/1957 | Hastings . | |
| 3,527,434 | 9/1970 | Mauro . | |
| 3,922,998 | 12/1975 | May . | |
| 3,936,967 | 2/1976 | Davis . | |
| 4,026,595 | 5/1977 | Jacks . | |
| 4,105,190 | 8/1978 | Curtis | 40/604 X |
| 4,456,126 | 6/1984 | Hicks, Jr. . | |
| 4,875,302 | 10/1989 | Noffsinger | 40/610 |
| 4,959,916 | 10/1990 | Cochrane | 40/603 |

*Primary Examiner*—Kenneth J. Dorner
*Assistant Examiner*—J. Silbermann
*Attorney, Agent, or Firm*—Curtis, Morris & Safford

[57] ABSTRACT

A collapsible display frame apparatus for use as a motor vehicle roof-top display, wherein a collapsible frame includes rods forming an underleaf perimeter and an overleaf perimeter, coupling means for connecting the rods to define a corner joint, a flexible display, fasteners for attaching the display to each perimeter, and a swivel-slide joint for slidably interconnecting the frame of the underleaf and overleaf perimeters.

16 Claims, 3 Drawing Sheets

MOTOR VEHICLE ROOF-TOP DISPLAY FRAME ASSEMBLY

This application is a continuation-in-part of application Ser. No. 07/556,190 filed on Jul. 20, 1990, now abandoned.

FIELD OF THE INVENTION

This invention relates to a collapsible car top banner advertisement display frame; more particularly, a car banner advertisement display frame which is easily transported and has a size large enough to accommodate large banner advertisements for special events such as sporting events, music events, fairs, and the like.

Moreover, the invention relates to a motor vehicle roof-top frame for advertising and, more specifically, to a frame combination that secures and holds such advertising, and to a frame combination which is easily attachable to the roof-top of a motor vehicle such as a truck, van, or car all-the-while allowing for the unfolding, folding and transportation of these banner advertisements.

BACKGROUND OF THE INVENTION

Typically, vehicular roof-top advertising is secured to a vehicle by roof-top brackets, a roof-top frame or by such means as permanently mounted brackets, e.g., brackets attached with screws, rivets, welding or other methods known to the art. For example, as with advertisements used on taxi cabs, the roof-top frame is permanently affixed and allows for the advertising, in the form of cardboard inserts or posters, to be inserted or removed from these roof-top frames, slidably interchanging the advertising therein. Typically, these roof-top advertising frames are non-collapsible having a fixed rectangular or triangular shape.

In general, these fixed and non-collapsible roof-top frames are made from heavy and bulky materials. These frames are assembled into a predetermined, permanent configuration by welding or the like. Furthermore, these frames must withstand the repeated abuses of city traffic, rain and snow, and other hazards.

A disadvantage of the fixed and non-collapsible vehicular roof-top frames is that these frames tend to be small and the advertising inserted therein is confined to a small size and print area. Typically, this dictates the size of the print which can be used. Often this small print and overall size is inadequate for a roof-top banner advertising display, which is used at special events such as a baseball games, food festivals, fairs and the like, because the small size and print makes the message difficult read and understand. At special events where a display frame is used and attached to the vehicle roof-top, these roof-top displays have a frame which must be assembled and disassembled in order to transport the display or be used by driving the vehicle very slowly. In general, the banner advertisement display frame for these events requires a banner advertisement which has a larger overall dimension and size in order to promote greater visibility. It is therefore important to have a roof-top display frame to accommodate normally oversized banner advertisements and the subsequent larger print of these banner advertisements. This large print requirement is necessary because a booth, stand, etc., must be seen at great distances for the advertising to be effective.

Similarly, another disadvantage of the smaller print display frame assemblies is that these smaller frames tend to get concealed by the throngs of people attending such events when the advertisement is placed at or near eye level.

Furthermore, a high visibility of the banner advertising is needed because the advertising must be placed at a sufficient distance above the ground where crowds of people gather. For this purpose roof-tops of a van, etc., are used so that a sufficient angle between the viewer and the sign may be maintained at large distances. However, these roof-top devices are large, unwieldy, and not easily assembled and transported. Also, the direction and placement of the sign is important in that the display should be viewed from a frontal position and, if the banner is in the middle of special event, then from all sides. Therefore, the repositioning of these roof-top devices is made more difficult under conditions where disassembly is required.

A disadvantage of fixed and non-collapsible frames of the type typically used at a special event booth is in the amount of time and labor which is required to "set-up" or assemble and disassemble the display. In many situations, reducing the time and labor needed to set-up is advantageous and is reflected in significant cost savings for the special event production costs.

An advantage of a collapsible roof-top display frame, such as for the present invention, is in the increased labor savings associated also with mobility for the present banner advertisement combination. It is advantageous to be able to move the sign for a new placement within the boundaries of the special event grounds. It is also important at events such as baseball games, rock concerts or fairs that the advertising can fit through the low overhanging entrances at a stadium, or be transported under and around trees at county fair grounds without damaging the vehicle roof-top display frame. Therefore, a collapsible large banner type advertising is advantageous for special events and, furthermore, mobility is needed to position accurately the advertisement around obstacles present at stadium and fair grounds.

DESCRIPTION OF THE PRIOR ART

Car top advertising has been prevalent for a long time. Typically, it is of a fixed and non-collapsible type, such as used on a taxicab or on sides of a truck or trailer. Furthermore, at predetermined periodic intervals, political campaigns also use vehicular banner type displays, sometimes being made from rigid and heavy materials and, more often than not, creating a heavy and unstable roof-top display frame.

BRIEF DESCRIPTION OF THE INVENTION

The present invention provides a new and improved collapsible roof-top display frame assembly for a motor vehicle which combines both the advantages of increased mobility and collapsible construction to fold and transport large banner advertisements to special events such as baseball games, car races, fairs and the like. The collapsible construction of the frame combination allows for the easy folding of large banner advertisements. Furthermore, the device according to the present invention is made of light weight, yet of durable construction having a simplified design which reduces the time and labor required to make, erect and use, and thus the costs of manufacturing and exhibition construction.

Additionally, the present invention provides for a simplified vehicular roof-top banner and multi-sectional display frame combination that provides a very simple folding and unfolding design reducing the steps needed for exhibition construction and thus saving set-up time at these special events.

Furthermore, the present invention provides a kit for constructing a collapsible roof-top display frame assembly which provides the necessary individual elements needed to construct numerous frame shapes such as rectangles, triangles, silhouettes, and the like.

Other features, benefits, and advantages according to the present invention will become apparent from the following detailed description of an illustrated embodiment shown in the accompanying drawings.

DETAILED DESCRIPTION OF THE DRAWINGS AND DESCRIPTION EMBODIMENT OF THE PRESENT INVENTION

Figure 1:
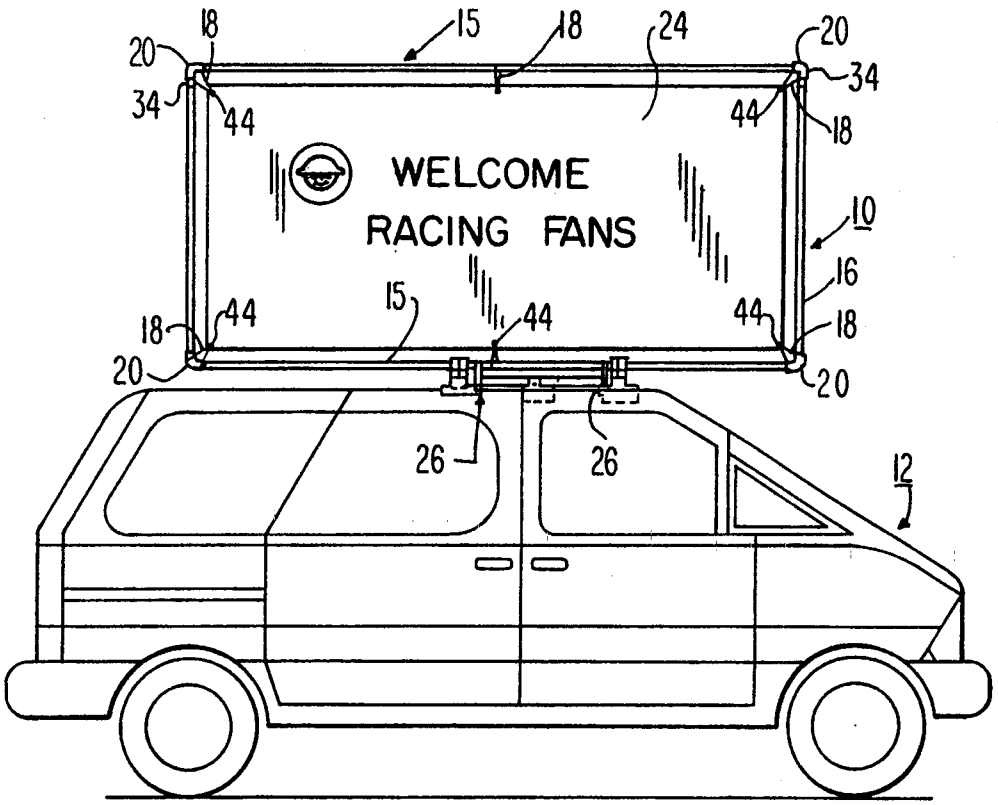
FIG. 1, is a schematic side view of the unfolded display frame according to an embodiment of the present invention.

The present invention provides an improved vehicular roof-top collapsible display frame assembly for mobile advertising. Referring to FIG. 1, the collapsible frame assembly combination shown generally as 10, is attached to a pair of universal carrier mountings 14. Universal carrier mountings 14 such as the well-known "Thule" or "Yakima" trademarked roof-top carriers are placed on the roof-top of a motor vehicle 12. The collapsible frame assembly 10, placed into a carrier pocket 32 (an accessory such as, for example, a ski carrier) of the universal carrier mounting 14 and is secured by a suitable means therein. Each of the universal carrier mountings 14 has straps 26 which tighten and position the universal carrier mounting 14 on the roof-top of the vehicle 12 and may further be used to secure secondarily the collapsible frame assembly 10 to the universal carrier mounting 14.

The banner advertisement portion of the collapsible frame assembly 10 comprises a banner or display 24 connected by elastic cords 18 or equivalent elastic or line lacings to the horizontal and vertical side sections 15 and 16, respectively. The elastic cords 18 are strung through finished holes 44 of the display 24. For a canvas display 24 such holes may be in the form of grommets.

Figure 3:
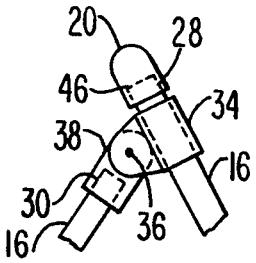
FIG. 3, taken of the blow-up section 3 shown in FIG. 2, is an enlarged fragmentary sectional view of a socket swivel and slide joint according to an embodiment of the present invention.

The collapsible frame assembly 10 is comprised of a plurality of horizontal side sections 15 and vertical side sections 16, a plurality of elbow joints 20, a banner or display 24, connected by elastic cords 18, and the horizontal and vertical side sections 15 and 16 are interconnected by a universal joint or socket swivel-slide joint 22, shown in more detail in FIG. 3 herein. This combination is vastly preferred to a permanently mounted display.

Figure 2:
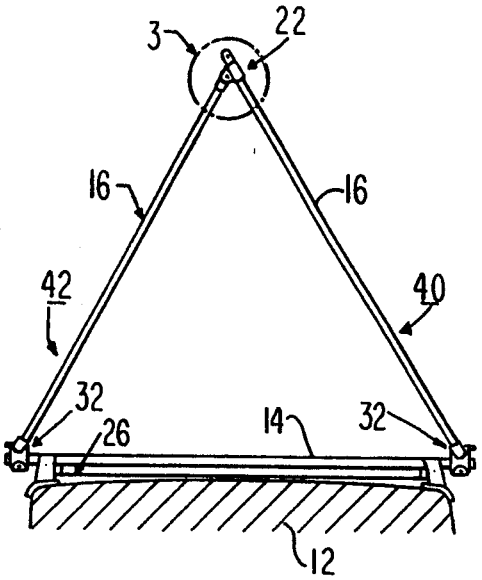
FIG. 2, is a schematic end-view of the unfolded display frame according to an embodiment of the present invention.

Referring to FIG. 2, according to an embodiment of the present invention, the horizontal side sections 15 are longer than the vertical side sections 16 thereby forming a large rectangle. However, the invention is not limited by such dimensions, and may be constructed with dimensions as to particular needs for a display, such as display 24 shown in FIG. 5. Furthermore, the display 24 may be constructed into different shapes such as triangles, parallelograms and the like, provided an universal swivel joint or a disconnectable joint is used, as further described herein. Such a universal swivel joint may be preferably constructed of low friction materials such as, for example, nylon.

Figure 4:
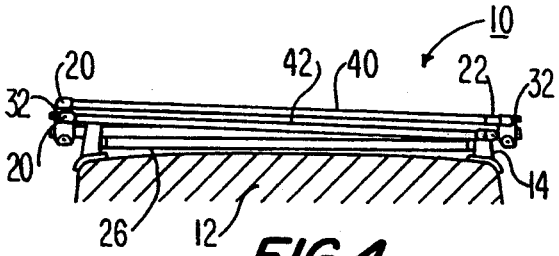
FIG. 4, is a schematic view of the folded display frame according to an embodiment of the present invention.

The collapsible frame assembly 10 may also be defined in terms of an overleaf perimeter 40 and a underleaf perimeter 42 such as shown in FIG. 4 for illustrating the advantageous setup of the roof-top display frame at a special event. The overleaf perimeter 40 is interconnected to the underleaf perimeter 42 by means of the socket swivel-slide joint 22. The overleaf perimeter 40 and underleaf perimeter 42 further define the A-frame shape of the collapsible frame assembly 10 according to an embodiment of the present invention. The maximum across-the-roof length in this embodiment is that allowable under the applicable highway rules for a typical vehicle. However, for an oversized or wide load, the maximum length may be longer depending on the applicable rules and regulations.

Referring to FIG. 1, the horizontal and vertical side sections 15 and 16, respectively, are connectively secured by the elbow joints 20 and thus form the overleaf perimeter 40 and underleaf perimeter 42 as shown in FIGS. 2 and 4. The overleaf perimeter 40 requires four sides or, simply, two vertical side sections 16 and two horizontal side sections 15 thereby defining a complete rectangle. Whereas, the underleaf perimeter 42 needs only three sides or two vertical side sections 16 and one horizontal side section 15 thereby defining a U-shaped structure. Overall, the collapsible frame assembly 10 requires seven side sections: four vertical side sections 16, each being of equal length, and three horizontal side sections 15, each also of equal length. The two vertical side sections 16 defining the underleaf perimeter 42 may further be shortened slightly such that when the overleaf perimeter 40 and underleaf perimeter 42, which are slidably connected by socket swivel-slide joint 22 therebetween, are folded, the overleaf perimeter 40 and underleaf perimeter 42 may lay flat and, further, can be maintained securely in the folded position, as shown in FIG. 4.

The horizontal and vertical side sections 15 and 16, respectively, define the overleaf perimeter 40 and underleaf perimeter 42 in such dimensions, typically, to accommodate two (2) large four-by-eight foot banners and transporting the same to an event. The horizontal and vertical side sections 15 and 16 may be constructed from a metal such as stainless steel, aluminum, and the like. However, the horizontal and vertical side sections 15 and 16 are not limited to metal. These may also be made from any material readily available, such as resin reinforced with fiberglass, carbon fiber or the like, which demonstrate the properties of durability, lightweight construction, great strength, and a non-corrosive nature.

In this embodiment of the present invention, the horizontal and vertical side sections 15 and 16, respectively, have a diameter of 7/8 inches, however, it is not limited to such. The diameter of the horizontal and vertical side sections 15 and 16 may vary upon the desired application and needs of the purchaser, and, furthermore, the overall perimeter dimension of the collapsible frame assembly 10, such as dictated by the material used and strength needed.

Referring to FIG. 2, according to an embodiment of the present invention, the overleaf perimeter 40 and the underleaf perimeter 42 further define an A-frame shape of a near-equilateral triangle. Each of the side ends 46 of each of the horizontal and vertical side sections 15 and 16 of the overleaf perimeter 40 are further connected by elbow joints 20. These elbow joints 20 have a shape of 90 degree corner, however, if the roof-top display frame assembly perimeter shape is a triangle, then the corner defined thereby is 60 degrees (and so forth for other shapes). Furthermore, the length of the base may vary.

Referring to FIG. 3, the elbow joints 20 and socket swivel-slide joint 22 will be now further described. The elbow joint 20 having an elbow hole 28 for accepting either a horizontal or vertical side section 15 and 16, respectively, securely connects each of the side ends 46 of a vertical and horizontal side section 16 and 15 defining a corner thereby. The socket swivel-slide joint 22 comprises a sliding sleeve 34, a socket swivel end 38, a pivot point pin 36, and said socket swivel end 38 having a socket hole 30 for accepting either a vertical or horizontal side section 16 and 15, respectively.

Referring to FIG. 3, the elbow joint 20 has a 90° (degree) bend forming a corner. Each horizontal and vertical side section 15 and 16 of the overleaf perimeter 40 is coupled together by inserting a side end 46 of each respective horizontal and vertical side section 15 and 16, respectively, into each elbow hole 28 on either side of the elbow joint 20. This coupling engagement securely connects the horizontal and vertical side sections 15 and 16, respectively, and these side ends 46 may be securely attached by adhesives, crimping, joining with screws, or any other attachment method known to the art. The elbow joints 20 may be made from any durable material. In using standard manufacturing techniques, the elbow joints 20 of the collapsible frame assembly 10 may be made at an extremely low cost. The elbow joints 20 may further be made out of nylon, and other non-corrosive yet durable materials.

Still referring to FIG. 3, the socket swivel-slide joint 22 slidably interconnects the overleaf perimeter 40 and underleaf perimeter 42. Each of the vertical side sections 16 of the underleaf perimeter 42 is inserted in the socket hole 30 of the socket swivel-slide joint 22 and may be secured thereto by means such as adhesives, threading, crimping, or one or more set screws and other methods known to the art. The sliding sleeve 34 is slidably mounted around each of the vertical side sections 16 of the overleaf perimeter 40 and is made of nylon which is self-lubricating and thus no periodic maintenance or oiling is needed.

Referring to FIG. 1, display 24 may be constructed from canvas, or any other strong light material or fabric. The term fabric is used in this application, to mean both a woven material such as canvass or nylon, or a nonwoven film material, such as one of the synthetic polymer films well known to the art. Examples of useful polymer films include nylon, polyethylene terephthalate (MYLAR TM), and polyvinylfluoride film (TEDLAR TM) etc. According to an embodiment of the present invention, the typical dimensions of such a large size is four-by-eight feet. The display 24 further has finished holes 44 which may have an plastic or metal grommet type construction. These finished holes 44 interconnect with the elastic cords 18 and thus allow for the longevity and durability of the display 24 as the finished holes 44 are crimped thereon. The display 24 is connected to the horizontal and vertical side sections 15 and 16, respectively, by a number of elastic cords 18 which hold it taut, under tension, and in place, however, it may be attached by other suitable and equivalent means other than the elastic cords 18.

Referring to FIG. 4, the underleaf perimeter 42 is shown folded under the overleaf perimeter 40 in the ideal transportation position. The sliding sleeve 34 of the socket swivel-slide joint 22 slidably moves along the vertical side section 16 of the overleaf perimeter 40 to a folded or collapsed position. As the sliding sleeve 34 moves along the vertical side section 16 of the overleaf perimeter toward carrier pocket 32, socket swivel end 38 pivots around pivot point 36 until vertical side section 16 of the underleaf perimeter is substantially parallel with side section 16 of the overleaf perimeter. At the folded position, the socket swivel-slide joint 22 is stopped at the lower level elbow joint 20 of the overleaf perimeter 40, as shown in FIG. 4.

Figure 5:
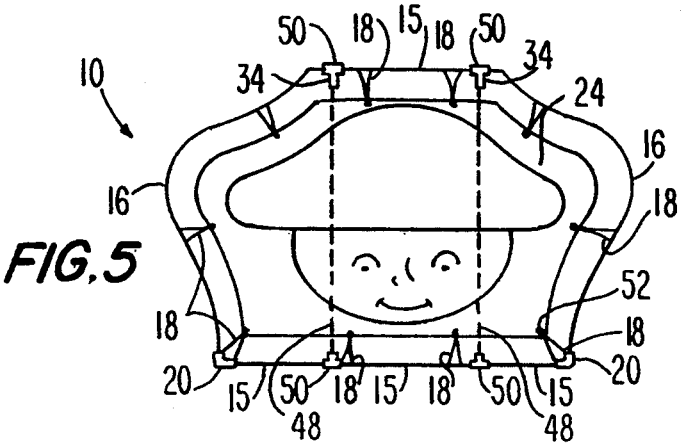
FIG. 5, is a schematic side-view of an irregularly shaped collapsible frame assembly according to an alternative embodiment of the present invention.
Figure 6:
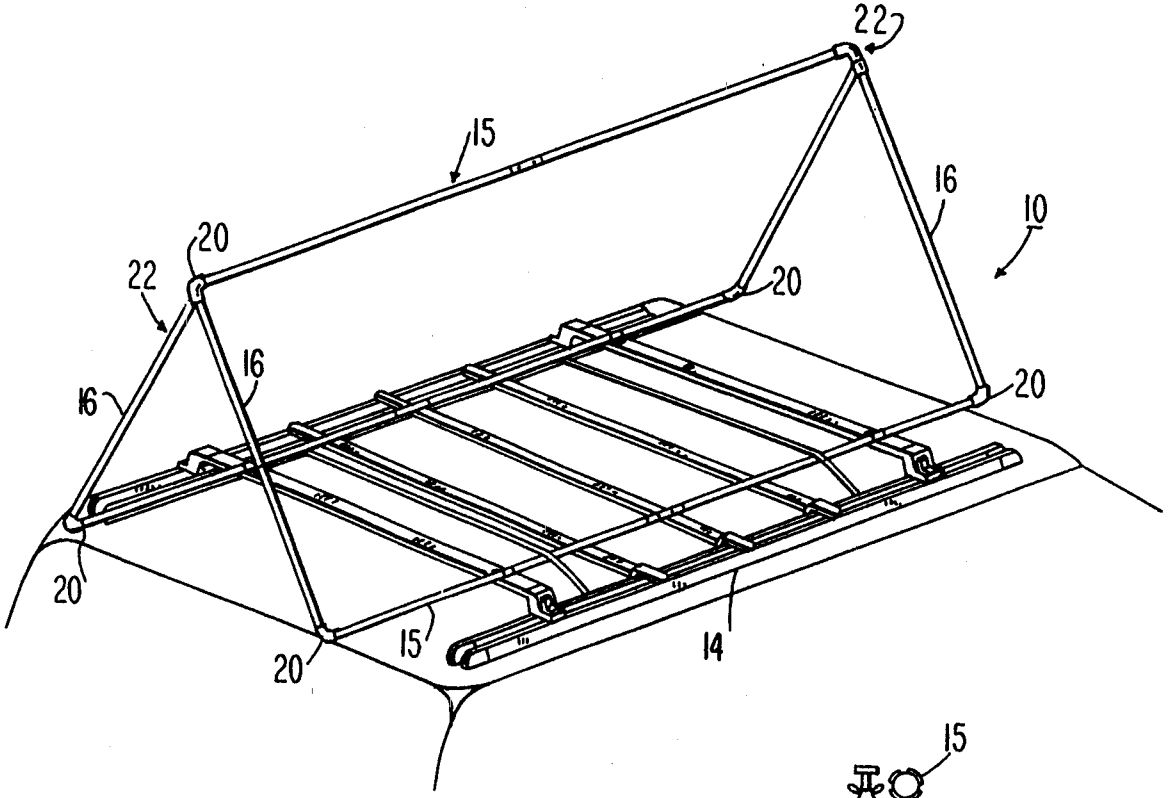
FIG. 6, a skewed aerial view of the display frame in the erect position.
Figure 7:
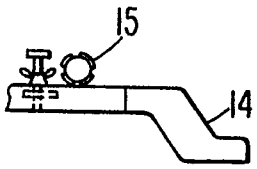
FIG. 7, is an enlarged fragmentary sectional view of a mechanism for securing the display frame to a vehicle roof top.

In an alternative embodiment of the present invention, the collapsible frame assembly 10 may define different shapes such as a triangle, a parallelogram, a semicircular radius, a silhouette, and the like. In essence, the shape of the display 24 dictates the shape of the collapsible frame assembly 10. The overleaf and underleaf perimeters 40 and 42, respectively, may form of each of these different frame shapes and may be slidably connected by the same socket swivel-slide joint 22 as shown in FIG. 3. For example, if display 24 is of a triangular shape requiring a triangular collapsible frame assembly 10, then the overleaf perimeter 40 is comprised of three side sections 16 of equal length having an additional bracing 48 (as shown in FIG. 5) made from vertical side section 16 bisecting the triangular overleaf perimeter 40. The bracing 48 slidably interconnects the underleaf perimeter 42 having the socket swivel-slide joint 22 placed at the apex of the upper-most-corner thereof. Thus, the socket swivel-slide joint 22 and the bracing 48 are slidably interconnected in such a way so that as the overleaf and underleaf perimeters 40 and 42, respectively, are folded into the collapsed position (shown if FIG. 4), the socket swivel-slide joint 22 attached to bracing 48 (shown in FIG. 5) travels in a straight line. Each of the above-mentioned other shapes may incorporate one or more vertical side sections 16, shown as bracing 48, being slidably interconnected with socket swivel-slide joint 22 such that the socket swivel-slide joint 22 follows a straight line when folding or unfolding.

In the above alternate embodiment of the present invention which the frame assembly is made from the abovementioned shapes other than a rectangle and the socket swivel-slide joint 22 may be attached to a vertical side section 16 defining the overleaf perimeter 40, the socket swivel-slide joint 22 may be made from a conventional universal joint turning on a further axis to give relief for changes in direction such as when the vertical middle bracing is not used. Typically, this would occur when the socket swivel-slide joint 22 must follow the outline formed by the vertical side section 16 of the overleaf perimeter 42 being set-off at an angle such as in a triangle or parallelogram. In this manner, the socket swivel-slide joint 22 need not be attached to vertical bracing and the latter need not be used.

In a further embodiment of the present invention wherein the above-mentioned shapes would require the vertical side section 16 to undergo a change in length as well as a change in direction, the vertical side sections 16 of the underleaf perimeter 42 may incorporate additional structures. In these situations, these vertical side sections 16 of the underleaf perimeter 42, which are slidably connected to the overleaf perimeter 40, may incorporate a double-tube vertical side section assembly (not shown) for extending through maximum and minimum lengths when the vertical side sections 16 of the overleaf perimeter 40 are set-off at an angle. These double-tube vertical side section assemblies go through a maximum and minimum extension of length upon folding or unfolding from the collapsed position. Furthermore, these double-tube vertical side section assemblies may incorporate means for changing direction, as well as length, such as the above-mentioned universal joint or by simply allowing the double-tube section to rotate. The double-tube design may incorporate further a means such as a fast-pin or spring loaded detent pin or equivalents to hold the collapsible frame assembly in the unfolded position (shown in FIG. 2) and, also, to release for folding to the collapsed position (shown in FIG. 4). This release means allows movements which vary the overall length of the vertical side section 16 of the underleaf perimeter 42 and thus the release of fast-pins allows the vertical side section 16 to extend or relax slidably traveling down the vertical side section 16 of overleaf perimeter 40 when folding.

In an alternate embodiment of the present invention, the overleaf perimeter 40 and the underleaf perimeter 42 are entirely detachable. These perimeters may be detachable from the socket swivel-side joint 22 allowing for the collapsible frame assembly 10 to simply fold each perimeter assembly or from the above-mentioned double-tube vertical side section assembly. Furthermore, a fast-pin of a conventional type could secure each perimeter in the unfolded position as shown in FIG. 2.

In a further embodiment of the present invention, the collapsible frame assembly may be sold in a kit form. In such a kit, horizontal and vertical side sections 15 and 16 respectively, would be provided and these could be bent into different shapes or cut to the appropriate dimensions thus forming different frame shapes. The kit further comprises elastic cords 18, the elbow joints 20 and T-joint 50 connectors, the socket swivel-slide joints 22, and display material with grommets 52 for the banner display 24. Referring to FIG. 5, such a kit could make a silhouette-shaped collapsible frame assembly. Such a silhouette-shaped collapsible frame assembly 10 would have vertical side sections 16 for bracing 48 placed in the middle thereof to accept the socket swivel-slide joint 22 providing thereby a collapsible frame assembly 10.

Although a preferred embodiment of the present invention has been described in detail herein, it is to be understood that this invention is not limited to that precise embodiment, and that many modifications and variations may be effected by one skilled in the art without departing from the invention as defined by the appended claims.

I claim:

1. A collapsible frame assembly suitable for exhibition of flexible display means, which comprises:

frame means for holding said flexible display means, including a front perimeter comprising at least three support rods configured in a shape suitable for supporting said flexible display means, and a rear perimeter comprising at least three support rods configured in a shape suitable for supporting said front perimeter in an exhibition position, wherein the front perimeter and the rear perimeter are slidably interconnected such that the frame assembly can be collapsed from said exhibition position to a folded position and wherein an end of the rear perimeter slides along a side of the front perimeter when the frame means is collapsed from the exhibition position to the folded position;

coupling means for connecting the support rods of the front perimeter together and the support rods of the rear perimeter together;

flexible display means mounted within the front perimeter of the frame means;

a plurality of fastening means for attaching the flexible display means to the front perimeter of the frame means; and joint means for interconnecting the support rods of the front perimeter to the support rods of the rear perimeter.

2. A collapsible frame assembly as set forth in claim 1, wherein said frame means includes metal tubing.

3. A collapsible frame assembly as set forth in claim 1, wherein said frame means includes tubing of composite carbon fiber.

4. A collapsible frame assembly as set forth in claim 1, wherein said coupling means is made of nylon plastic.

5. A collapsible frame assembly as set forth in claim 1, wherein said flexible display means is constructed from lightweight fabric.

6. A collapsible frame assembly as set forth in claim 1, wherein said means for attaching is elastic cords.

7. A collapsible frame assembly as set forth in claim 1, wherein said joint means is constructed of low friction material.

8. A collapsible frame assembly and suitable for exhibition of a flexible display, comprising:

a plurality of frame members defining a front perimeter and a plurality of frame members defining a rear perimeter, said front perimeter and said rear perimeter being joined by at least one slidably movable joint connecting at least one front perimeter frame member to at least one rear perimeter frame member in adjustable abutting engagement such that the frame assembly can be collapsed from an exhibition position to a folded position;

said flexible display having a plurality of finished holes for accepting a fastener to connect the display to the frame members of said front perimeter; and said at least one slidably movable joint consisting of a sleeve member through which one of said plurality of frame members of the front perimeter is inserted, and a socket member pivotally attached to the sleeve member and configured to receive one of said plurality of rear perimeter frame members inserted into said socket member.

9. A collapsible frame assembly as set forth in claim 8, wherein the flexible display is made of canvas.

10. A collapsible frame assembly as set forth in claim 8, wherein the fastener is a cord.

11. A collapsible frame assembly as set forth in claim 8, wherein the slidable moveable joint is a universal joint.

12. A kit for a collapsible frame assembly for mounting on a vehicle and suitable for exhibition of a display, which comprises:

a plurality of frame members defining a front frame perimeter and a plurality of frame members defining a rear frame perimeter wherein the front frame perimeter and the rear frame perimeter each includes at least two support rods for generally vertical orientation when said assembly is in an exhibition position and having top ends and bottom ends in such generally vertical orientation and at least two support rods for generally horizontal orientation when said assembly is in an exhibition position and having left and right ends in such generally horizontal orientation;

a plurality of coupling joints for connecting selected ends of the support rods for generally vertical orientation with selected ends of the support rods for generally horizontal orientation;

a display supported within the front frame perimeter;

a plurality of fasteners to attach the display to the front frame perimeter;

slidable pivoted joints for slidable interconnecting the top ends of the support rods for generally vertical orientation of the front frame perimeter to the top ends of the support rods for generally vertical orientation of the rear frame perimeter; and a roof-top support having a plurality of hollows to accept the bottom ends of the support rods for generally vertical orientation of the front and rear frame perimeters.

13. A kit for a collapsible frame assembly as defined in claim 12, wherein the coupling joints are elbow joints.

14. A frame assembly as set forth in claim 1, wherein said frame means includes tubing of composite fiberglass.

15. A frame assembly as set forth in claim 1, wherein said frame means includes tubing made of a ceramic.

16. A frame assembly as set forth in claim 1, wherein said frame means includes tubing made of a plastic.

* * * * *